US010337839B2

(12) United States Patent
Worthington et al.

(10) Patent No.: US 10,337,839 B2
(45) Date of Patent: Jul. 2, 2019

(54) FORMABLE ARMORS USING CERAMIC COMPONENTS

(71) Applicant: Sierra Protective Technologies, Walnut Creek, CA (US)

(72) Inventors: Timothy Worthington, Largo, FL (US); Guy Leath Gettle, Alamo, CA (US); Vincent R. Homer, Independence, OR (US)

( * ) Notice: Subject to any disclaimer, the term of this patent is extended or adjusted under 35 U.S.C. 154(b) by 0 days.

(21) Appl. No.: 15/117,727

(22) PCT Filed: Feb. 13, 2015

(86) PCT No.: PCT/US2015/015871

§ 371 (c)(1),
(2) Date: Aug. 10, 2016

(87) PCT Pub. No.: WO2015/175048

PCT Pub. Date: Nov. 19, 2015

(65) Prior Publication Data

US 2017/0167828 A1 Jun. 15, 2017

Related U.S. Application Data

(60) Provisional application No. 61/966,166, filed on Feb. 14, 2014.

(51) Int. Cl.
*F41H 5/04* (2006.01)

(52) U.S. Cl.
CPC ..... *F41H 5/0492* (2013.01)

(58) Field of Classification Search
CPC .... F41H 5/0492; F41H 5/0414; F41H 5/0421; F41H 5/0428; F41H 5/0435
USPC ..... 89/36.01, 36.02, 36.04; 428/911
See application file for complete search history.

(56) References Cited

U.S. PATENT DOCUMENTS 3,573,150 A * 3/1971 Broutman ..... B32B 27/00 2/2.5
3,705,558 A * 12/1972 McDougal ..... F41H 5/0421 109/84
5,114,772 A * 5/1992 Vives ..... C04B 35/80 428/49
6,911,247 B2 * 6/2005 Howland ..... F41H 5/0492 428/114
8,281,700 B2 * 10/2012 Cohen ..... F41H 5/0492 89/36.02
8,322,267 B2 * 12/2012 Altergott ..... F41H 5/04 29/402.09
8,590,438 B2 * 11/2013 Simovich ..... F41H 5/0492 89/36.02
8,628,857 B2 * 1/2014 Simovich ..... C04B 35/563 428/327
8,701,540 B2 * 4/2014 Hunn ..... B22D 19/00 89/36.02

(Continued)

*Primary Examiner* — John Cooper
(74) *Attorney, Agent, or Firm* — Ramberg IP, LLC

(57) ABSTRACT

A formable armor that resists penetration by impacting projectiles. The instant formable armor features a plurality of cylindrical ceramic barrels each having flat ends that fay with the flat surfaces of adjacent ceramic barrels. Rows of faying cylindrical barrels are disposed parallel to one another. The substantially parallel rows of cylindrical ceramic barrels are affixed to a backing layer that maintains continuous contact between adjacent cylindrical barrels.

6 Claims, 2 Drawing Sheets

(56) References Cited

U.S. PATENT DOCUMENTS

| | | | | |
|---|---|---|---|---|
| 8,746,122 | B1 * | 6/2014 | Roland | F41H 5/04 89/36.02 |
| 8,985,001 | B2 * | 3/2015 | Hunn | F41H 5/0407 109/49.5 |
| 9,052,164 | B2 * | 6/2015 | Simovich | F41H 5/007 |
| 2011/0107904 | A1 * | 5/2011 | Queheillalt | F41H 5/023 89/36.02 |

* cited by examiner

FORMABLE ARMORS USING CERAMIC COMPONENTS

TECHNICAL FIELD

This invention relates to composite armors that can be flat or formed to profiles other than flat, and specifically to composite armors employing ceramic components to stop ballistic projectiles.

BACKGROUND ART

Composite armors are comprised of discrete components that are embedded within a continuous matrix. The discrete components may be textile layers, filamentary fibers, or hard geometric shapes such as parallelograms, spheres, and pyramids. Composite armors may comprise a single layer, or alternatively several layers.

Composite armors are generally preferred over homogeneous armor materials because they can stop most projectiles with less weight and smaller thickness. The design of composite armors is a complex matter, however, and many factors must be considered in the design process.

To resist perforation by projectiles traveling at velocities exceeding 500 meters per second, hard components are generally required. These may be embedded within a single composite armor layer. Against more massive or denser projectiles having greater kinetic energies, a composite armor having more than one layer is generally required. In these cases, hard components are arranged to be the first armor layer encountered by a projectile upon impact. This first armor layer is typically called the "strike face".

Hard layers and components are used because they induce stresses in the impacting projectile that deform and possibly cause its disintegration. Such hard materials add cost, weight and thickness to the armor, however. Composite armor design typically requires that the designer minimize all three of these factors.

Strike faces of armors made with the present art are either metallic or ceramic. Ceramics are increasingly used as the strike face because they are generally less dense than steel and denser metals that are needed to defeat projectiles with high kinetic energies. However, ceramics are prone to shattering. Once shattered, ceramics lose their ability to withstand additional projectile impacts.

Ceramic strike faces generally comprise a plurality of plates or smaller tiles. These must be bonded to reinforcing layers. Additionally, hard ceramic plates and tiles typically are encapsulated by textile layers infused with protective resins. This is because ceramics are susceptible to damage by mechanical impacts, such as when dropped on a hard surface or struck by metal tools. Once cracks or microcracks are formed within ceramics, their theoretical resistance to projectiles is seriously diminished. Such microcracks generally propagate faster than projectile impact velocities so that projectiles penetrate into damaged ceramic material.

Employment of smaller ceramic shapes such as spheres and pyramids require their encapsulation or embedment within a matrix of resin or soft metal. This is for the same reason as encapsulation of ceramic tiles and plates. Additionally, restraint within a continuous matrix ensures uniform distribution of multitudinous small shapes. Usually such shapes are arrayed in multiple layers.

Ceramic plates and tiles generally allow thinner composite armor assemblies than armors comprising multitudinous hard shapes arrayed in layers. However, the smaller shapes tend to deflect projectiles and absorb momentum from them.

Projectiles may then yaw or "tumble" because of slight deflections. The area of the yawed projectile pressing against the armor is then increased greatly compared with a pointed tip at normal incidence on armor plate. The result of projectile yaw is to reduce penetration capability of the projectile. Thus composite armors utilizing multitudinous hard components are often more efficient with respect to weight and thickness than those using plates and tiles.

One drawback of using arrays of numerous ceramic shapes is that there is much less ceramic thickness and mass near or in interstices and contacting surfaces of contiguous hard objects. Pointed projectiles may penetrate against much less resistance in these grooves and spaces. The momentum of projectiles may also allow easy transverse displacement of the ceramic components and thus they may continue forward without significant loss of kinetic energy. The actual resistance of composite armors to projectiles having only a single array of hard ceramic shapes is thus uncertain, as resistance varies substantially with precise projectile impact location.

For this reason, multiple layers of hard object arrays are generally used. The shapes of neighboring layers substantially occupy interstices and gaps. Such multiple layers leave no gaps for projectiles to exploit. Multiple layers of ceramic shapes allow the designer to use different sizes and shapes of these hard components.

Although composite armors incorporating hard armor plates and multiple layers of hard geometric shapes are generally effective in stopping projectiles, such armors have inherent drawbacks. One drawback is that such composite armors required to stop artillery shell fragments and projectiles fired by automatic weapons cannot be made flexible or in curved shapes without creating numerous places where hard component thickness is substantially reduced. Another major shortcoming is that they are relatively heavy and thick.

Improved means of producing composite armors are highly desirable. Many advantages would accrue if such protection means can be provided with much less mass and bulk compared with armor made using the present art. Additional uses and advantages would accrue from lighter and thinner composite armors that could be formed into curved shapes.

DISCLOSURE OF THE INVENTION

In view of the inability to form curved composite armors that can stop dense projectiles impinging at velocities greater than 500 meters per second, novel means are required. The present invention accordingly offers a means for substantially reducing weight and assembly thickness while stopping dense projectiles impacting at high velocities.

As discussed in greater detail elsewhere, the present invention contemplates a formable armor assembly consisting of a plurality of cylindrical ceramic barrels having flat ends faying with the flat surfaces of adjacent ceramic barrels, with rows of faying cylindrical barrels disposed in rows parallel to one another. Length of each cylindrical ceramic barrel would be at least equal to the maximum diameter but not greater than twice the maximum diameter. All of the cylindrical ceramic barrels are affixed to a backing layer.

The backing may be metal, with the cylindrical ceramic barrels affixed by means of an adhesive. Alternatively, the backing may be a composite comprising filamentary materials or textiles embedded within a matrix. The matrix material may be a resin, such as an epoxy or polyurethane. Alternatively, the matrix material may be a metal. With a composite backing, the cylindrical ceramic barrels may be bonded by the same matrix material used to encapsulate the filaments or textiles in the backing layer.

When a metal serves as the matrix material, encapsulation may be accomplished by melting the metal, then immersing the cylindrical ceramic components in the desired relative positions. If desired, encapsulation by metallic materials could also be accomplished by means of powder metallurgy fabrication processes. For organic resin matrix materials, several processes widely used in the manufacture of composite materials are usable to encapsulate the ceramic components. This possibility gives armor designers further additional options.

A preferable alternative embodiment of the formable armor is where each cylindrical ceramic barrel has a fossa or groove on the curved surface into which a congruent cylindrical ceramic barrel can fit. In cross section, the grooves would be arcuate. When viewed in cross section, the arcs representing the grooves are parallel for flat armors.

Alternatively, cylindrical ceramic barrels having grooves may be affixed to the backing such that arcs of cross sections representing grooves may be rotatably disposed with respect to one another in order to produce curved armor profiles. Curved armors can have changing radii of curvature, be fabricated as cylindrical assemblies, or made in sinusoidal forms. Other curved forms are readily made through the present invention.

Another preferable alternative embodiment of the basic invention is an assembly comprising a plurality of cylindrical ceramic barrels having ceramic separator components disposed between the curved surfaces of contiguous barrels. The ceramic separator components would have grooves on opposing sides with radius of curvature that allows continuous faying with each cylindrical barrel on the mating surfaces.

Cross section of the ceramic separator components placed between cylindrical barrels would thus resemble an apple core with bites taken from opposing sides. The curved outer surface of each cylindrical barrel would nest in the fossa of contiguous hard ceramic separators without leaving a significant gap therebetween. The maximum distance between the curved surfaces of the grooves on opposite surfaces on each ceramic separator component is approximately equal to the diameter of the cylindrical ceramic barrels being separated. Sequences of alternating cylindrical ceramic barrels and ceramic separator components are disposed in substantially parallel rows.

The invention contemplates the ceramic shapes comprising the same material as the cylindrical ceramic barrels, although this need not be the case in all embodiments. The use of ceramic-metal mixtures would be allowed in an alternative embodiment, such as mixture of 80% silicon carbide and 20% aluminum. Such ceramic-metal materials are generally called "cermets".

A further preferable alternative embodiment would utilize encapsulants or coatings on the faying surfaces comprising materials that have a higher acoustic impedance than the ceramic components. Acoustic impedance is the mathematical product of material density and the velocity of the shock wave generated by projectile impact in a given material. Examples of preferable materials that have a higher acoustic impedance than ceramics include steels with a chromium content exceeding 17%, zinc, copper, and nickel.

The curved surfaces without grooves of each ceramic separator component would have radii of curvature equal to or greater than the radius of curvature of the cylindrical barrels. The curved surfaces without grooves of ceramic separator components would be on opposing sides, with one curved surface disposed to face potential impact by projectiles. Radius of curvature for the opposing surfaces of ceramic separator components need not be equal in the present invention, but may be as determined by the armor designer.

Another embodiment utilizes a frontal layer that is affixed to the array of ceramic components on the surfaces opposite the backing layer. In this embodiment, impacting projectiles would strike this optional layer before impinging upon any ceramic component.

The frontal layer may be a homogeneous material such as a metal. Alternatively, the layer may be a composite comprising filaments or textiles encapsulated in a continuous matrix. The matrix in such a composite may be a resin, a metal, or a cermet. This optional layer is substantially parallel to the backing layer. Materials comprising the optional layer in this alternative embodiment may be the same as those in the backing layer, but are not required to be so.

When ceramic separator components are utilized, a further alternative embodiment has round core components placed in holes in each ceramic separator component. Round core components in this embodiment may be solid or tubular in cross section. Materials comprising round core components preferably have an acoustic impedance at least that of the ceramic core component within which the round core component is placed. This material may be the same as that of the surrounding ceramic separator component in this alternative embodiment.

Round core components should fit tightly in the holes, preferably disposed so that a compressive stress is maintained on the faying surfaces. Length of the round core component may be identical to the depth of the hole in the ceramic separator component. Alternatively the round core components may be longer than the ceramic separator component is thick. Each ceramic separator component in this alternative embodiment may have its own round core component, or the round core component may be a rod or tube that goes through a plurality of ceramic separator components.

In a further embodiment where single rods or tubes extend through a plurality of ceramic separator components, the rods or tubes protrude beyond the outermost ceramic separator components. The protruding ends in this further embodiment are embedded or otherwise are disposed in holes in an enclosing structure.

This structure may preferably be a frame or structural member. Alternatively, the entire formable armor assembly may be encapsulated in a resin, wherein the protruding rods or tubes are embedded. The resin may be strengthened with filamentary materials comprised of glass, aramid or polyethylene compositions in this alternative embodiment.

The optional enclosing structure may be assembled from components having holes formed to accommodate the protruding round component ends. Alternatively, the enclosing structure or frame can be formed around the formable armor. In this alternative, the backing layer and optional frontal layer can be formed from resin with reinforcing filaments or fibers integral to the enclosing structure or frame simultaneously in the same process.

Objects and Advantages

Accordingly and in view of the above summary, the invention offers a number of objects and advantages set forth as follows:

(a) to prevent penetration of projectiles by means of thinner composite armors;

(b) to reduce weight of armors capable of protecting against projectiles impacting at high velocities;

(c) to allow fabrication of armors with curved surfaces and complex forms; and (d) to reduce the mass of expensive ceramic components required to stop dense projectiles designed to pierce armors.

MODES FOR OPERATING THE INVENTION

The various drawing figures accordingly depict a number of embodiments according to the present invention. The embodiments are summarized below. A more detailed description of the respective figures follows.

Figure 1:
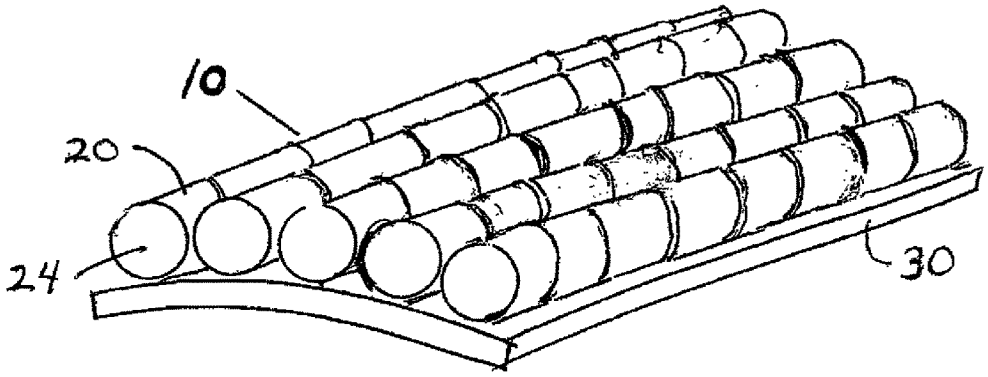
FIG. 1 is an isometric view that shows the basic embodiment of the formable armor using cylindrical ceramic shapes affixed to a backing layer.

FIG. 1 shows the basic embodiment of the formable armor using cylindrical ceramic shapes affixed to a backing layer. The formable armor 10 comprises a plurality of cylindrical ceramic barrels 20. The cylindrical ceramic barrels in this embodiment are disposed in rows with collinear principal axes perpendicular to the flat ends 24 of each barrel. The cylindrical ceramic barrels are affixed to a backing layer 30. The planes of the flat ends may, but need not be, parallel. Cylindrical ceramic barrels may, but need not be, the same length.

Figure 2:
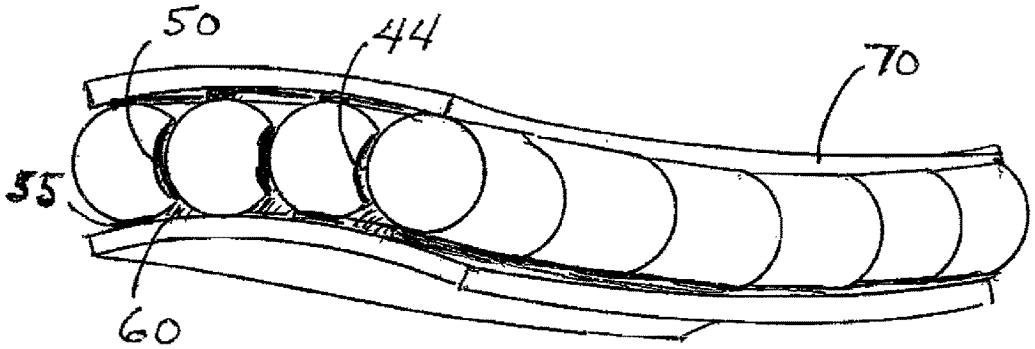
FIG. 2 is an isometric view that illustrates an alternative embodiment of the formable armor.

FIG. 2 illustrates an alternative embodiment of the formable armor. A groove 44 is present on the curved surface of each cylindrical ceramic barrel. Grooves are parallel to the axis of the cylindrical barrel. Optional thin metal layers 50 are depicted on the surfaces of grooves in this illustration. Such thin metal layers may be bonded to one or both contiguous components with an adhesive 55 or alternatively deposited by spraying or dipping in molten metal. The interstices or spaces between the ceramic components and backing layer in this figure are filled by an optional resin 60. An optional frontal layer 70 is affixed to the formable armor.

Figure 3:
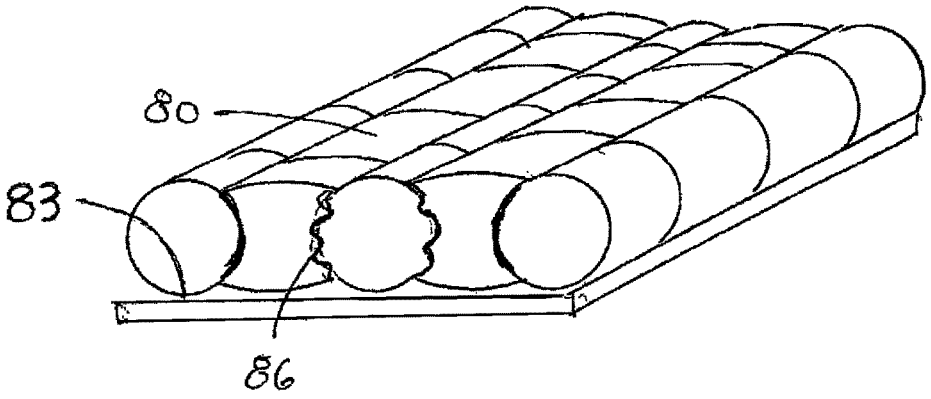
FIG. 3 is an isometric view that depicts a preferable alternative embodiment in which ceramic separator components 80 having grooves on opposite surfaces are disposed between contiguous cylindrical ceramic barrels.

FIG. 3 depicts a preferable alternative embodiment in which ceramic separator components 80 having grooves on opposite surfaces are disposed between contiguous cylindrical ceramic barrels. Ceramic components may further resist relative displacements by means of an adhesive 83. The surfaces of cylindrical ceramic barrels and ceramic separator components may be smooth. Alternatively, cylindrical ceramic barrels and ceramic separator components may have multiple serrations 86 on faying surfaces. Serrations serve to resist relative displacement.

Figure 4:
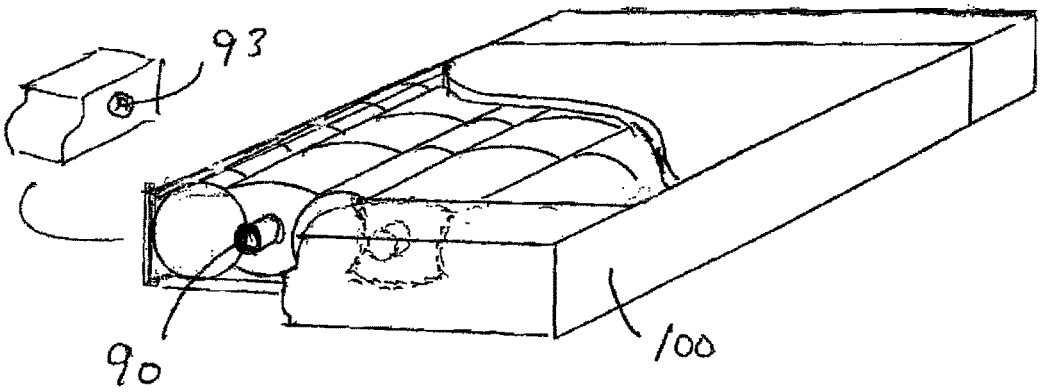
FIG. 4 is an isometric cutaway view that illustrates a further preferable alternative embodiment in which optional round core components 90 are placed in round holes 93 of ceramic separator components.

FIG. 4 illustrates a further preferable alternative embodiment in which optional round core components 90 are placed in round holes 93 of ceramic separator components. The round core components in this figure are depicted as protruding beyond the surfaces of the outermost ceramic separator components and embedded in an optional resin frame 100. A portion of the resin frame is removed in this illustration to show the ends of ceramic separator components and round core components.

Advantages

The invention offers numerous alternatives for a person skilled in the art to design composite armors that could form curved surfaces while being thinner and lighter than those produced using the present art. Through the present invention one skilled in the art can add one or more reinforcing layers, including metal and ceramic armor plates. Importantly, composite armors made with any of embodiments of the present invention, whether flat or curved, will have a continuous layer of ceramic components of almost constant thickness. This constant thickness ensures that there are no weak locations through which impacting projectiles can easily penetrate. Smaller individual ceramic components ensure that damaged zones remain limited, enabling the formable armors to withstand multiple projectile impacts in a small area.

This advance in capability would make protection against projectiles possible in many applications where weight and space limitations for would render such protection impossible through the current art. The invention makes possible capabilities now that are not possible currently using existing materials, and can utilize new materials yet to be developed.

Operation

The formable armor, such as that shown in FIG. 1, becomes operable when a projectile impinges on the first surface of the composite armor. The first surface, or strike face, in the basic embodiment will be a cylindrical ceramic barrel. In alternative embodiments, an impinging projectile will strike either a ceramic component or the optional front layer.

In the basic embodiment of the formable armor, projectile impact transmits a pressure wave that travels through the cylindrical ceramic barrel. When the pressure wave reaches the surface of the cylindrical ceramic component away from the impact point, part of the momentum and part of the kinetic energy of the projectile is transmitted into contiguous cylindrical ceramic barrels. Energy and momentum transfer is then further dissipated to other components comprising the armor. A compressive wave will be reflected back from the surface into the ceramic component impacted by the projectile. When a layer having higher impedance than the ceramic component is present on the surface, the compressive wave will be stronger.

For projectile impacts at velocities exceeding 500 meters per second, the intense compressive stresses generated by impact typically produce a region of severe damage in ceramics. This shattered zone forms roughly one projectile diameter beneath the point of impact.

For projectile diameters in the range of 7.62 millimeters to 15 millimeters, the damage zone will form from 5 to 10 millimeters deep. Microcracks are developed in the damage zone that will propagate through the ceramic material and form larger cracks. Crack propagation velocity is typically 8 to 10 millimeters per microsecond (Strassberger et al, 2002). Crack propagation velocity is similar to the speed of the shock wave transmitting through the damaged ceramic.

When the shock wave generated by projectile impact reaches an interface with a material of lower impedance, such as air, adhesives, or organic resins, a relaxation wave is produced. This relaxation wave reflects back into the damaged ceramic. The relaxation wave reduces the compressive stress across crack interfaces and may produce a tensile stress. The reflected relaxation wave-thus allows damaged ceramic material to dislocate or spall. When the relaxation wave reaches the impact surface, general failure of the ceramic occurs. Once this happens, the projectile can then easily move through the failed ceramic material.

The present invention prevents general failure from developing. This happens because compressive waves are reflected at the interfaces with contiguous components before relaxation waves can reach incipient cracks. By maintaining high compressive pressures on crack surfaces, friction forces are strongly increased along crack interfaces. These forces resist crack extension.

Compressive stresses are maintained for long periods because compressive waves are continuously generated through the present invention along the curved surfaces of cylindrical ceramic barrels. The use of optional grooves, ceramic separator components, high-impedance interface materials, and round core components in ceramic separator components generate more intense compressive waves that form sooner. From these many contributions to forming and sustaining high compressive stresses in incipient cracks, ceramic armor components can stop projectiles more efficiently, and stop more energetic projectiles with the same mass of ceramic through the present invention than is possible with armors made with the present art.

Use of the optional frontal layer can be used to make the present invention even more efficient. Use of cermets as either frontal layer, backing layer or to fill interstices between ceramic components and the planar components can improve resistance of the formable armor even more. Curvature of the backing layer and radii of the ceramic components can be utilized by a person skilled in the art to further enhance performance of the present invention.

Use of round core components in ceramic spacer components is particular desirable for stopping blunt or large projectiles. Ceramics are especially vulnerable to blunt projectiles because the damage zone is wide. More ceramic area is subjected to severe compressive stresses upon impact by blunt projectiles. Large projectiles are similarly destructive in ceramics because more kinetic energy is transferred that adds to crack surface energy. Shock waves from large or blunt projectiles also typically reflect from interfaces faster than occurs for small or pointed projectiles. This causes general damage to develop sooner within the ceramic, thus allowing faster penetration by projectiles. The use of round core components can generate compressive waves faster than cracks can propagate, thereby limiting the damaged zones in ceramics even when subjected to large, blunt projectile impacts.

Location of components that quickly generate compressive stress waves in front of propagating cracks is thus critical. The nearest surface of components such as interface materials having high shock impedance should be within one projectile diameter of another surface having high shock impedance. Projectile diameter should be at least five millimeters but based upon the diameter of the projectile upon which design of the formable armor is based. In no case should the nearest surface having a high shock impedance be more than ten millimeters from the ceramic component surface impacted by a projectile.

The nearest surface of an interface is determined by either the backing layer, the nearest optional ceramic separator component, the optional round core component used in a ceramic separator component, or encapsulants or coatings on faying surfaces having high shock impedance. When round core components are used in ceramic separator components, the distance between the hole and nearest curved surface is at least three millimeters and not exceeding ten millimeters.

More than a decade of research has consistently shown that yield strength, ductility, and resistance to penetration by projectiles increase substantially when armor ceramics remain in a state of compression. Conversely, resistance to projectile penetration drops substantially for unconfined, uncompressed ceramics.

This is why the geometry of the ceramic shapes, the optional use of the ceramic separator component, the optional use of high-impedance materials between the ceramic components, and the optional metal strike face are so important. Among approaches within the current art is to use steel encasement or thin layers of aluminum or plastic encapsulation to provide compression. These materials have a similar or lower shock impedance than projectile metals. Although steel has a relatively high impedance, thick steel layers are not practical to manufacture and add too much weight. Aluminum offers impedance similar to armor ceramics such as silicon carbide and aluminum oxide at typical ballistic impact velocities, but these are inefficient in terms of weight and fabrication cost compared with the present invention. Thin layers of zinc, austenitic "stainless" steel alloys with chromium concentrations exceeding 17%, copper and nickel reflect much stronger compressive waves into the impacted ceramics than is possible through the current art.

Ramifications and Scope

Accordingly, the reader will observe that composite armors made through this invention would offer substantial protection against projectiles while allowing such armors to be curved into numerous profiles. Different embodiments of this invention make protection possible against a wide range of projectile sizes and shapes while conforming to the shapes of interior surfaces with a minimum requirement for space. Other embodiments of the present invention can cover curved exterior surfaces without intervening gaps or need for gussets and other supports.

Many other possibilities exist for a person skilled in the art to use the present invention to produce means of protection against projectiles impacting aircraft, structures, vehicles and people other than those described and illustrated above. The above embodiments are not intended to limit the application of concepts described above.

Variations and modifications in addition to those described above are believed obvious from the description. Accordingly, the scope of the invention is defined only by the following appended claims that are further exemplary of the invention.

What is claimed is:

1. A formable armor that resists penetration by impacting projectiles, comprising:

a plurality of cylindrical ceramic barrels each having a flat surface on opposing end surfaces, said cylindrical ceramic barrels faying on at least one flat surface, said plurality of cylindrical ceramic barrels fayinq on at least one flat surface disposed into at least two substantially parallel rows of cylindrical ceramic barrels;

said substantially parallel rows of cylindrical ceramic barrels affixed to a backing layer that maintains continuous contact between adjacent cylindrical barrels; and further wherein each cylindrical ceramic barrel has a longitudinal axis and a curved side surface, said formable armor further comprising a groove present on said curved surface and parallel to said axis.

2. The formable armor of claim 1, further comprising a metal layer located on a surface of said groove.

3. The formable armor of claim 2, wherein said metal layer is bonded to a contiguous cylindrical ceramic barrel.

4. A formable armor that resists penetration by impacting projectiles, comprising:

a plurality of cylindrical ceramic barrels each having a flat surface on opposing end surfaces, a longitudinal axis that is perpendicular to said flat opposing end surfaces, and a curved surface between said flat opposing end surfaces, said cylindrical ceramic barrels faying on at least one flat surface, said plurality of cylindrical ceramic barrels faying on at least one flat surface disposed into at least two substantially parallel rows of cylindrical ceramic barrels, said substantially parallel rows of cylindrical ceramic barrels affixed to a backing layer that maintains continuous contact between adjacent cylindrical barrels; and a groove disposed in said curved surface and oriented parallel to said longitudinal axis, and configured such that a congruent cylindrical ceramic barrel can fit into said groove.

5. The formable armor of claim 4, further comprising a resin filling in interstices between said cylindrical ceramic barrels and said backing layer.

6. The formable armor of claim 4, further comprising a frontal layer that is affixed to said plurality of cylindrical ceramic barrels opposite said backing layer.

* * * * *